US006949015B2

(12) United States Patent
Kubota

(10) Patent No.: US 6,949,015 B2
(45) Date of Patent: Sep. 27, 2005

(54) MACHINING APPARATUS EQUIPPED WITH ROTARY TOOL

(75) Inventor: Toru Kubota, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 10/763,280

(22) Filed: Jan. 26, 2004

(65) Prior Publication Data

US 2004/0149110 A1 Aug. 5, 2004

(30) Foreign Application Priority Data

Jan. 28, 2003 (JP) ..... 2003-019350

(51) Int. Cl.[7] ..... B24B 7/00
(52) U.S. Cl. ..... 451/178; 451/342; 125/13.01
(58) Field of Search ..... 451/342; 83/651, 83/663, 666

(56) References Cited

U.S. PATENT DOCUMENTS 4,679,296 A 7/1987 Watanabe et al.
4,813,122 A 3/1989 Watanabe et al.
4,989,374 A * 2/1991 Rudolf et al. ..... 451/342
5,090,849 A 2/1992 Arai et al.
5,430,944 A * 7/1995 Shilling ..... 30/388
6,171,176 B1 * 1/2001 Kajiyama et al. ..... 451/28
6,485,360 B1 * 11/2002 Hutchins ..... 451/357

FOREIGN PATENT DOCUMENTS

| | | |
|---|---|---|
| DE | 199 57 217 | 5/2001 |
| EP | 0 407 836 | 1/1991 |
| GB | 2 214 845 | 9/1989 |
| JP | 2003-203885 | 7/2003 |

* cited by examiner

*Primary Examiner*—Dung Van Nguyen
(74) *Attorney, Agent, or Firm*—Smith, Gambrell & Russell, LLP

(57) ABSTRACT

A machining apparatus comprises a rotating spindle mounted rotatably, a rotating drive source for rotationally driving the rotating spindle, a rotary tool detachably mounted on the rotating spindle, and a screwed member rotated and screwed to the rotating spindle for mounting the rotary tool on the rotating spindle. The machining apparatus is further provided with selective rotation inhibiting means for selectively inhibiting the rotation of the rotating spindle.

2 Claims, 5 Drawing Sheets

Fig. 5 – A
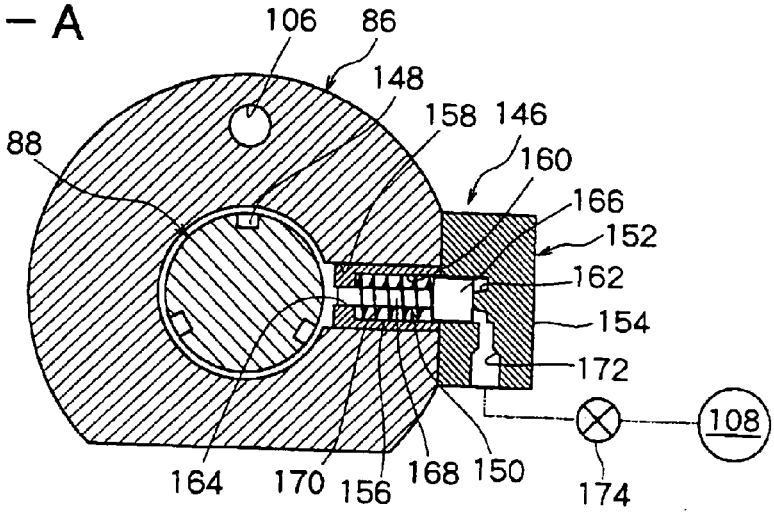
Fig. 5 – B
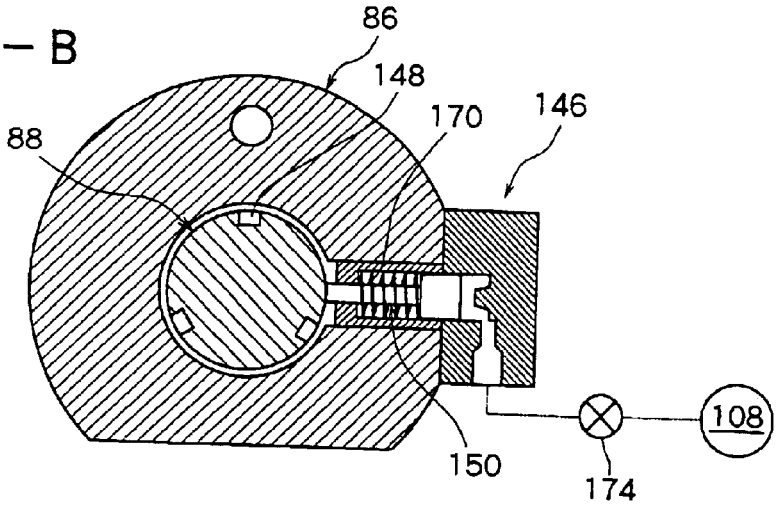
Fig. 5 – C
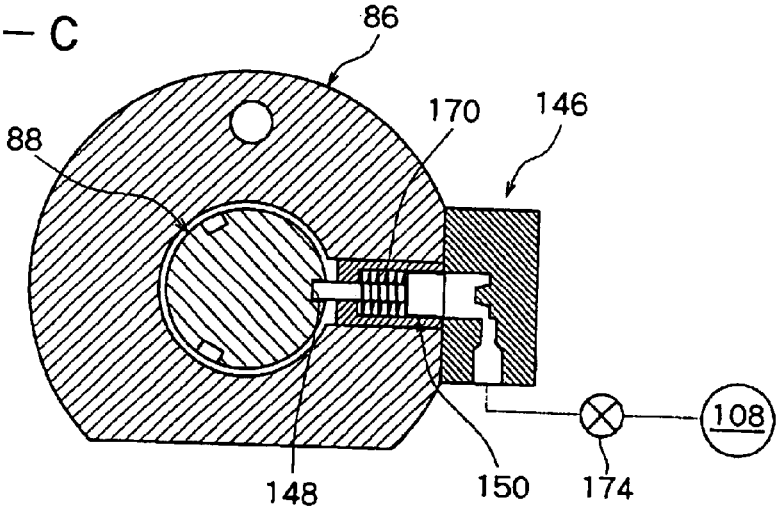

MACHINING APPARATUS EQUIPPED WITH ROTARY TOOL

FIELD OF THE INVENTION

This invention relates to a machining apparatus equipped with a rotary tool and, more specifically, a machining apparatus of a type having a screwed member screwed to a rotatably mounted rotating spindle for detachably mounting a rotary tool onto the rotating spindle.

DESCRIPTION OF THE PRIOR ART

In the manufacture of semiconductor chips, a plurality of rectangular regions are demarcated by streets arranged in a lattice pattern on the face of a semiconductor wafer, and a semiconductor circuit is disposed in each of the rectangular regions. This semiconductor wafer is cut along the streets to separate the rectangular regions individually, thereby forming semiconductor chips. To cut the semiconductor wafer along the streets, a machining device called a dicer, as disclosed in Japanese Patent Application Laid-Open No. 2003-203885, is advantageously used. Such a machining device is equipped with a rotating spindle mounted rotatably, a rotating drive source for rotationally driving the rotating spindle, and a rotary tool detachably mounted on the rotating spindle. The rotary tool is composed of an annular cutting blade containing diamond grains.

A screwed member to be screwed to the rotating spindle is used for mounting the rotary tool on the rotating spindle. More particularly, as disclosed in the above-mentioned Japanese Patent Application Laid-Open No. 2003-203885, a mounting implement is fixed to a front end portion of the rotating spindle, and the rotary tool is fixed to the mounting implement. A taper portion gradually decreasing in outer diameter toward the front end of the rotating spindle is formed in the front end portion of the rotating spindle, and a through-hole gradually decreasing in internal diameter toward the front end of the mounting implement is formed in the mounting implement, so that the through-hole of the mounting implement is fitted over the taper portion of the rotating spindle. An external thread is formed at the front end of the rotating spindle, or an internally threaded hole is formed at the front end of the rotating spindle. A nut member is screwed onto the external thread, or a bolt member is screwed into the internal thread, with the result that the mounting implement is forced rearwardly by the head of the nut member or the bolt member. In this manner, the through-hole of the mounting implement is closely fitted around the taper portion of the rotating spindle, whereby the mounting implement is fixed to the rotating spindle fully reliably.

However, the following problems to be solved are present in the conventional machining device configured as described above: In mounting the rotary tool on the rotating spindle, or in removing the rotary tool, which has worn upon use, from the rotating spindle for replacement, it is necessary to rotate the screwed member relative to the rotating spindle, thereby to screw the screwed member to the rotating spindle or screw the screwed member off the rotating spindle. For this screwing-on or screwing-off, there is need to rotate the screwed member while inhibiting the rotation of the rotating spindle. A manual operation for performing, in parallel, the rotation of the screwed member and the inhibition of rotation of the rotating spindle is considerably complicated and difficult. To inhibit the rotation of the rotating spindle sufficiently reliably, a special tool for grasping the rotating spindle is required.

SUMMARY OF THE INVENTION

A principal object of the present invention is to provide a novel and improved machining apparatus which, when a rotary tool is mounted on or removed from a rotating spindle, can reliably inhibit the rotation of the rotating spindle without requiring a special tool or a complicated manual operation, and thus can perform the mounting of the rotary tool on, and its removal from, the rotating spindle with sufficient ease.

According to the present invention, for attaining the above object, there is provided a machining apparatus comprising a rotating spindle mounted rotatably, a rotating drive source for rotationally driving the rotating spindle, a rotary tool detachably mounted on the rotating spindle, and at least one screwed member screwed to the rotating spindle for mounting the rotary tool on the rotating spindle, wherein selective rotation inhibiting means is disposed for selectively inhibiting the rotation of the rotating spindle.

Preferably, the selective rotation inhibiting means includes at least one stop concavity formed in an outer peripheral surface of the rotating spindle, and a stop member to be selectively located at an operating position where the stop member engages the stop concavity, and a nonoperating position where the stop member recedes from the stop concavity. Preferably, a plurality of the stop concavities are formed at intervals in a circumferential direction. It is preferred that the selective rotation inhibiting means includes an accommodation member having, formed therein, an accommodation hole having an opening opposed to the outer peripheral surface of the rotating spindle, the stop member is slidably accommodated in the accommodation hole, and when the stop member is located at the operating position, its front end portion partly protrudes from the opening of the accommodation hole, while when the stop member is located at the nonoperating position, its substantial whole is accommodated in the accommodation hole. Preferably, the selective rotation inhibiting means includes elastic biasing means for elastically biasing the stop member to the nonoperating position, and forced slide means for selectively sliding the stop member to the operating position against the elastic biasing action of the elastic biasing means. The forced slide means preferably causes compressed air to act on the rear end of the stop member. The rotary tool may be of a form having an annular cutting blade containing diamond grains.

BRIEF DESCRIPTION OF THE DRAWINGS

FIGS. 5-A to 5-C are cross-sectional views taken on line V—V of FIG. 4.

DETAILED DESCRIPTION OF THE PREFERRED EMBODIMENTS

The machining apparatus constructed according to the present invention will now be described in greater detail by reference to the accompanying drawings showing its preferred embodiments.

Figure 1:
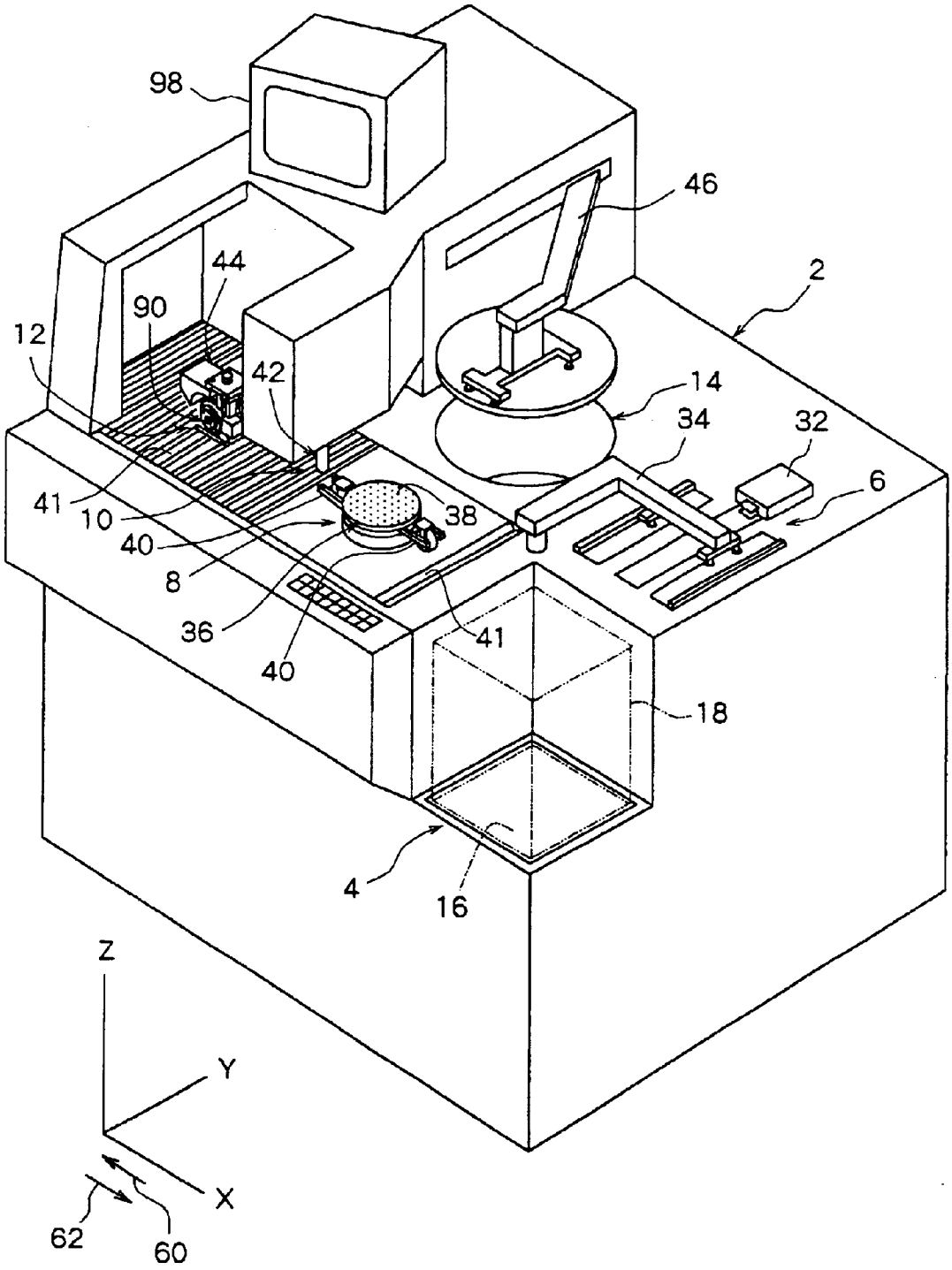
FIG. 1 is a perspective view showing the whole of a preferred embodiment of a machining apparatus constructed according to the present invention.

FIG. 1 shows a machining apparatus, called a dicer, a typical example of a machining device to which the present invention is applied. The illustrated machining apparatus has a housing 2, and a loading zone 4, a standby zone 6, a chucking zone 8, an alignment zone 10, a cutting zone 12, and a cleaning/drying zone 14 are defined on the housing 2. A hoisting/lowering table 16 is disposed in the loading zone 4, and a cassette 18 is loaded on the hoisting/lowering table 16. A plurality of semiconductor wafers 20 (FIG. 2) are housed with spacing in an up-and-down direction within the cassette 18.

Figure 2:
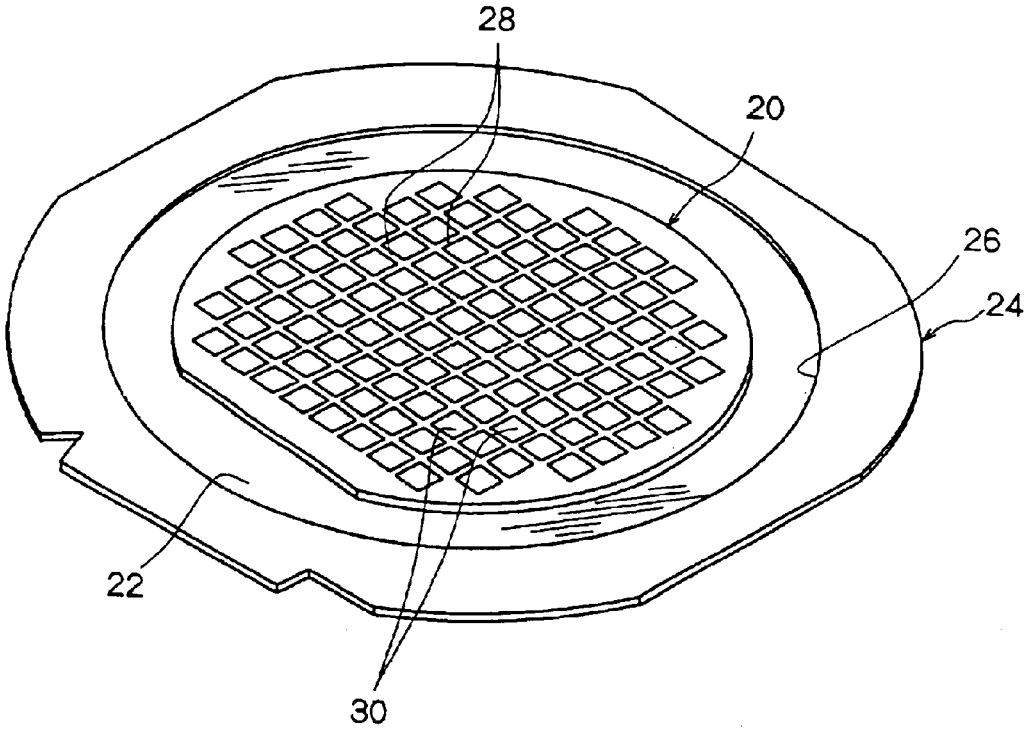
FIG. 2 is a perspective view showing a semiconductor wafer to be cut by the machining apparatus of FIG. 1, the semiconductor wafer being mounted on a frame via a mounting tape.

As clearly shown in FIG. 2, the semiconductor wafer 20 accommodated in the cassette 18 is mounted on a frame 24 via a mounting tape 22. The frame 24, which can be formed of a metal or synthetic resin, has a relatively large circular opening 26 at the center thereof. The mounting tape 22 extends across the circular opening 26, and is stuck to the back of the frame 24. The semiconductor wafer 20 is located within the circular opening 26, and its back is stuck to the mounting tape 22. Streets 28 are arranged in a lattice pattern on the face of the semiconductor wafer 20, and a plurality of rectangular regions 30 are demarcated by these streets 28. A semiconductor circuit is disposed in each of the rectangular regions 30.

Further with reference to FIG. 1, a first transport means 32 is disposed in association with the loading zone 4 and the standby zone 6. The first transport means 32 is actuated in accordance with the ascent and descent of the hoisting/lowering table 16, whereby the frames 24 each mounted with the semiconductor wafer 20 to be cut are sequentially carried out of the cassette 18 onto the standby zone 6. (As will be further mentioned later, the frame 24 mounted with the semiconductor wafer 20, which has been cut, cleaned and dried, is carried from the standby zone 6 into the cassette 18.) A second transport means 34 is disposed in association with the standby zone 6, the chucking zone 8, and the cleaning/drying zone 14. The frame 24 carried out of the cassette 18 onto the standby zone 6 is transported to the chucking zone 8 by the second transport means 34. In the chucking zone 8, the frame 24 and the semiconductor wafer 20 mounted thereon are held by chuck means 36. In further detail, the chuck means 36 has a chuck plate 38 having a substantially horizontal attraction surface, and a plurality of suction holes or grooves are formed in the chuck plate 38. The semiconductor wafer 20 mounted on the frame 24 is placed on the chuck plate 38, and vacuum attracted onto the chuck plate 38. A pair of grasping means 40 are disposed in the chuck means 36, and the frame 24 is grasped by the pair of grasping means 40.

As will be further described later, the chuck means 36 is moved in a first direction, i.e. an X-axis direction, on a substantially horizontal plane. The semiconductor wafer 20 held by the chuck means 36 is moved in accordance with the movement of the chuck means 36, and transported to the alignment zone 10 and the cutting zone 12 in this order. In the illustrated embodiment, bellows means 41, which are expanded and contracted according to the movement of the chuck means 36, are disposed on both sides (i.e., downstream side and upstream side) of the chuck means 36 as viewed in the X-axis direction. Alignment means 42 is disposed in association with the alignment zone 10. In the alignment zone 10, an image of the face of the semiconductor wafer 20 held on the chuck means 36 is produced, and the semiconductor wafer 20 is positioned sufficiently precisely, as required, according to this image. Then, the semiconductor wafer 20 is cut along the streets 28 in the cutting zone 12 by the action of cutting means 44. The rectangular regions 30 are individually separated by this cutting, but the mounting tape 22 is never cut thereby. Thus, the individually separated rectangular regions 30 continue to be mounted on the frame 24 via the mounting tape 22. The alignment means 42 and the cutting means 44 will be described in further detail later.

After the semiconductor wafer 20 is cut as required in the cutting zone 12, the chuck means 36 is returned to the chucking zone 8. A third transport means 46 is disposed in association with the chucking zone 8 and the cleaning/drying zone 14. The frame 24 and the semiconductor wafer 20 mounted thereon are carried into the cleaning/drying zone 14 by the third transport means 46. In the cleaning/drying zone 14, the semiconductor wafer 20 that has been cut is cleaned and dried by cleaning/drying means (not shown). Then, the frame 24 and the semiconductor wafer 20 mounted thereon are returned to the standby zone 6 by the second transport means 34, and then returned into the cassette 18 by the first transport means 32.

Figure 3:
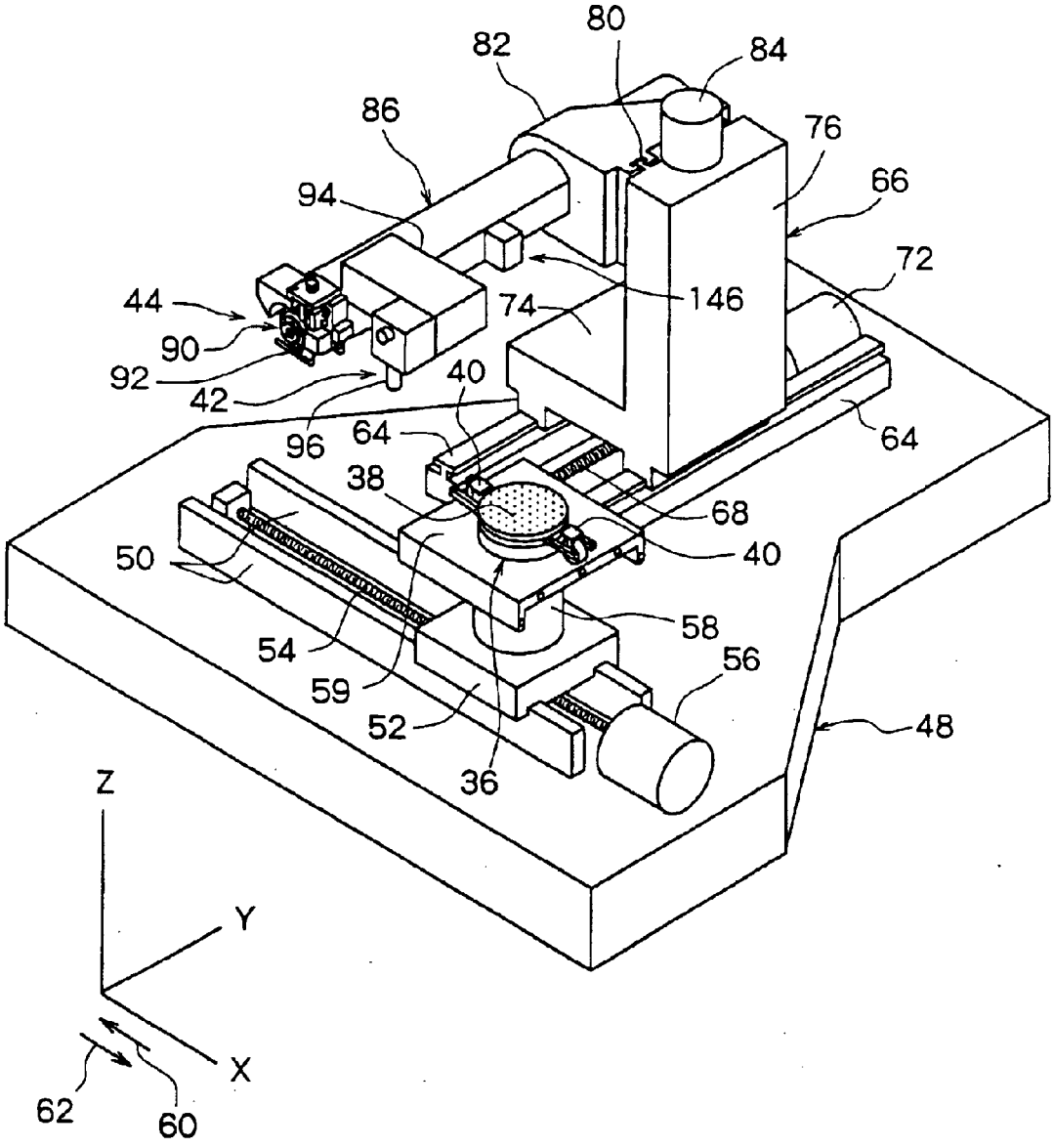
FIG. 3 is a perspective view showing cutting-related principal constituents of the machining apparatus of FIG. 1.

In FIG. 3, the top wall of the housing 2 and the bellows means 41 disposed on both sides of the chuck means 36 are omitted, and the constituents disposed below them are illustrated. With reference to FIG. 3 along with FIG. 1, a support board 48 is disposed within the housing 2. A pair of guide rails 50 extending in the X-axis direction are fixed onto the support board 48, and a slide block 52 is mounted on the pair of guide rails 50 so as to be movable in the X-axis direction. A threaded shaft 54 extending in the X-axis direction is rotatably mounted between the pair of guide rails 50, and an output shaft of a pulse motor 56 is connected to the threaded shaft 54. The slide block 52 has a hang-down portion (not shown) extending downward, and an internally threaded hole extending as a through-hole in the X-axis direction is formed in the hang-down portion. The threaded shaft 54 is screwed into the internally threaded hole. A support table 59 is fixed to the slide block 52 via a cylindrical member 58, and the chuck means 36 is also mounted thereon. Thus, when the pulse motor 56 is rotated in the normal direction, the support table 59 and the chuck means 36 are moved in a cutting direction indicated by an arrow 60. When the pulse motor 56 is rotated in the reverse direction, the support table 59 and the chuck means 36 are moved in a return direction indicated by an arrow 62. The chuck plate 38 and the pair of grasping means 40, which constitute the chuck means 36, are mounted so as to be rotatable about a central axis extending substantially vertically. A pulse motor (not shown) for rotating the chuck plate 38 and the pair of grasping means 40 is disposed within the cylindrical member 58.

A pair of guide rails 64 extending in a Y-axis direction are fixed to the support board 48, and a slide block 66 is mounted on the pair of guide rails 64 so as to be movable in the Y-axis direction. A threaded shaft 68 extending in the Y-axis direction is rotatably mounted between the pair of guide rails 64, and an output shaft of a pulse motor 72 is connected to the threaded shaft 68. The slide block 66 is of a nearly L-shape, and has a horizontal base portion 74, and an upright portion 76 extending upward from the horizontal base portion 74. A hang-down portion (not shown) extending downward is formed in the horizontal base portion 74, and an internally threaded hole extending as a through-hole in the Y-axis direction is formed in the hang-down portion. The threaded shaft 68 is screwed into the internally threaded hole. A pair of guide rails 80 (only the upper end of one of the guide rails 80 is shown in FIG. 3) extending in a Z-axis direction are formed in the upright portion 76 of the slide block 66. A connecting block 82 is mounted on the pair of guide rails 80 so as to be movable in the Z-axis direction. A threaded shaft (not shown) extending in the Z-axis direction is rotatably mounted on the upright portion 76 of the slide block 66, and an output shaft of a pulse motor 84 is connected to the threaded shaft. A protrusion (not shown) protruding toward the upright portion 76 of the slide block 66 is formed in the connecting block 82, and an internally threaded hole extending as a through-hole in the Z-axis direction is formed in the protrusion. The above-mentioned threaded shaft extending in the Z-axis direction is screwed into the internally threaded hole. The aforementioned cutting means 44 is mounted on the connecting block 82. The cutting means 44 has a casing 86 fixed to the connecting block 82, and a rotating spindle 88 (FIG. 4) extending in the Y-axis direction is rotatably mounted within the casing 86. A rotary tool 90 is detachably mounted on a front end portion of the rotating spindle 88. A cooling liquid jetting means 92 for jetting a cooling liquid, which may be pure water, is disposed at the front end of the casing 86. The cutting means 44 including the rotating spindle 88 and the rotary tool 90 will be described in further detail later.

When the pulse motor 72 is rotated in the normal direction, the slide block 66 is indexed forward in the Y-axis direction, whereby the rotary tool 90 is indexed forward in the Y-axis direction. When the pulse motor 72 is rotated in the reverse direction, the slide block 66 is indexed rearward in the Y-axis direction, whereby the rotary tool 90 is indexed rearward in the Y-axis direction. When the pulse motor 84 is rotated in the normal direction, the connecting block 82 is lowered in the Z-axis direction, whereby the rotary tool 90 is lowered in the Z-axis direction. When the pulse motor 84 is rotated in the reverse direction, the connecting block 82 is raised in the Z-axis direction, whereby the rotary tool 90 is raised in the Z-axis direction.

A support block 94 protruding in the X-axis direction is fixed to the casing 86, and a microscope 96 constituting the aforementioned alignment means 42 is mounted on the support block 94. When the chuck means 36 is located in the alignment zone 10, the chuck means 36 is located below the microscope 96, whereupon an optical image of the face of the semiconductor wafer 20 held on the chuck means 36 is incident on the microscope 96. The optical image entering the microscope 96 is picked up by imaging means (not shown), which can be constructed of CCD, for required image processing. Image signals after image processing are transmitted to control means, where they are utilized for alignment between the street 28 of the semiconductor wafer 20 and the rotary tool 90 of the cutting means 44. The image signals are also transmitted to a monitor 98 disposed on the housing 2, and displayed on the monitor 98.

Figure 4:
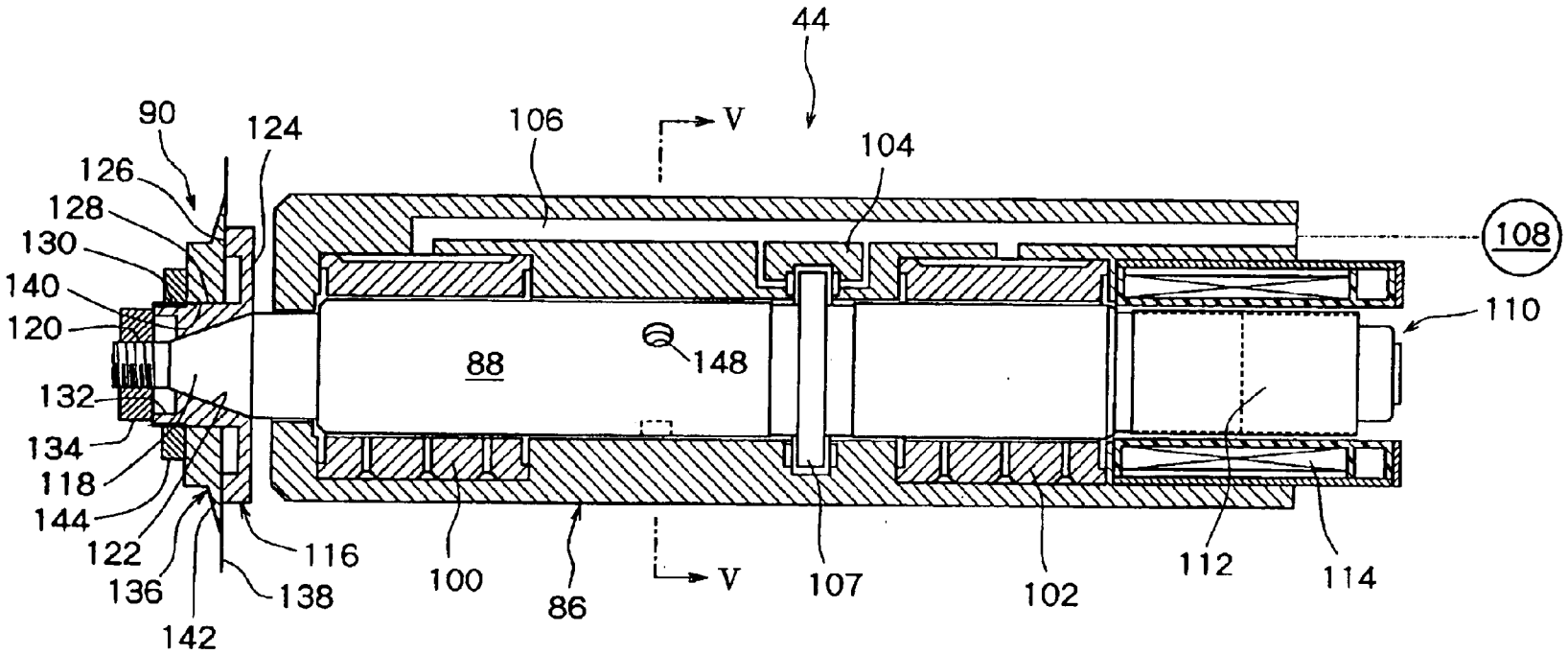
FIG. 4 is a sectional view showing cutting means in the machining apparatus of FIG. 1.

With reference to FIG. 4, two radial air bearings 100 and 102 are disposed at a distance in the axial direction within the casing 86 of the cutting means 44, and a thrust air bearing 104 located between these radial air bearings 100 and 102 is disposed within the casing 86. An air supply channel 106 communicating with the radial air bearings 100 and 102 as well as the thrust air bearing 104 is also formed in the casing 86. The air supply channel 106 is connected to a compressed air source 108, so that compressed air is supplied to the radial air bearings 100 and 102 and the thrust air bearing 104 via the air supply channel 106. The rotating spindle 88 is rotatably mounted by the radial air bearings 100 and 102 and the thrust air bearing 104. An annular flange 107 supported by the thrust air bearing 104 is formed on the rotating spindle 88. Because of the support of the annular flange 107 by the thrust air bearing 104, the axial movement of the rotating spindle 88 is restrained.

A rotating drive source 110 for rotating the rotating spindle 88 at a high speed is disposed within a rear end portion of the casing 86. The rotating drive source 110 in the illustrated embodiment is constituted of an electric motor including a rotor 112 mounted on a rear end portion of the rotating spindle 88, and a stator 114 disposed around the rotor 112. The rotor 112 is formed of a permanent magnet, while the stator 114 is formed of a coil.

A front end portion of the rotating spindle 88 protrudes from the casing 86, and the rotary tool 90 is mounted on this front end portion via a mounting implement 116. In more detail, a taper portion 118 gradually decreased in outer diameter toward the front end (left end in FIG. 4) of the rotating spindle 88 is disposed in the front end portion of the rotating spindle 88 which can be formed from a suitable metal such as stainless steel. An externally threaded portion 120 is disposed forwardly of the taper portion 118. The externally threaded portion 120 has an external diameter nearly corresponding to the minimum outer diameter of the taper portion 118, and an external thread is formed on the outer peripheral surface of the externally threaded portion 120. A through-hole 122 gradually decreased in internal diameter toward the front end of the mounting implement 116 is disposed in the mounting implement 116 which can similarly be formed from a suitable metal such as stainless steel. The taper angle of the taper portion 118 disposed in the rotating spindle 88, and the taper angle of the through-hole 122 disposed in the mounting implement 116 are set to be substantially the same. A flange 124 protruding radially outwardly is formed in a rear portion of the mounting implement 116, and an annular projection 126 jutting forward is formed on the front surface of an outer peripheral edge portion of the flange portion 124. The front surface of the annular projection 126 is substantially perpendicular to the central axis of the mounting implement 116. A mounting portion 128 and an externally threaded portion 130 are disposed forwardly of the annular projection 126. The mounting portion 128 has a cylindrical outer peripheral surface. The externally threaded portion 130 has nearly the same outer diameter as the outer diameter of the mounting portion 128, and has an external thread formed on its outer peripheral surface. An annular projection 132 jutting forward is formed on the front surface of the mounting implement 116, and the front end surface of the annular projection 132 is substantially perpendicular to the central axis of the mounting implement 116. As shown in FIG. 4, the through-hole 122 of the mounting implement 116 is fitted over the taper portion 118 of the rotating spindle 88. A screwed member, i.e. a nut member 134, is mounted on the externally threaded portion 120 of the rotating spindle 88. Thus, a force for urging the mounting implement 116 rearward (rightward in FIG. 4) is applied by the nut member 134 to the annular projection 132 of the mounting implement 116, whereby the through-hole 122 of the mounting implement 116 is brought into close contact with the taper portion 118 of the rotating spindle 88. As a result, the mounting implement 116 is fixed to the rotating spindle 88.

With further reference to FIG. 4, the rotary tool 90 in the illustrated embodiment is composed of a hub 136 and an annular cutting blade 138. A through-hole 140, which has substantially the same internal diameter as the outer diameter of the mounting portion 128 of the mounting implement 116, is formed in a central portion of the hub 136 which can be formed from a suitable metal such as aluminum. An annular flange 142 is formed at the rear end of the hub 136.

A rear surface of the hub 136 (namely, the rear surface of the annular flange 142) and a front surface thereof extend substantially perpendicularly to the central axis of the hub 136. The annular cutting blade 138 is in the form of an annular thin plate, whose inner peripheral portion is fixed to an outer peripheral portion of the rear surface of the annular flange 142 of the hub 136, and whose outer peripheral portion protrudes beyond the outer peripheral edge of the annular flange 136. The annular cutting blade 138 may, for example, be a so-called electroformed blade formed by dispersing diamond grains in an electrodeposition metal, such as nickel, to be electroplated on the annular flange 142 of the hub 136. The thus configured rotary tool 90, as clearly illustrated in FIG. 4, is fitted on the mounting portion 128 of the mounting implement 116, and then the screwed member, i.e. nut member 144, is screwed onto the externally threaded portion 130 of the mounting implement 116, whereby the rotary tool 90 is detachably mounted on the mounting implement 116. The nut member 144 has a rear surface substantially perpendicular to the central axis thereof. The nut member 144 is screwed to the externally threaded portion 130 of the mounting portion 116, to interpose the rotary tool 90 between the annular projection 126 of the mounting portion 116 and the rear surface of the nut member 144, thereby mounting the rotary tool 90 in place.

In the machining apparatus constructed in accordance with the present invention, it is important that selective rotation inhibiting means for selectively inhibiting the rotation of the rotating spindle 88 be disposed. With reference to FIGS. 5-A to 5-C along with FIG. 4, selective rotation inhibiting means indicated entirely at a numeral 146 includes at least one stop concavity 148 formed in an outer peripheral surface of the rotating spindle 88 (preferably, a plurality of stop concavities 148 formed at equal intervals in the circumferential direction), and a stop member 150 cooperating with the stop concavity 148. In more detail, in the illustrated embodiment, three of the stop concavities 148 are formed at equal intervals in the circumferential direction in the outer peripheral surface of the rotating spindle 88. Each of the stop concavities 148 may be circular in cross section. On the other hand, an accommodation member 152 is mounted on the casing 86. This accommodation member 152 is formed by coupling together a base portion 154 in the form of a rectangular parallelopiped, and a protuberant portion 156 in the shape of a cylindrical column, which protrudes from the inner side surface of the base portion 154, by a suitable means such as adhesion. A through-hole 158 having an inner diameter corresponding to the outer diameter of the protuberant portion 156 of the accommodation member 152 is formed in the wall of the casing 86. The accommodation member 152 is fixed to the casing 86 by having its protuberant portion 156 inserted into the through-hole 158 of the casing 86, and applying a suitable fastening means (not shown) such as a fastening screw. An accommodation hole 160 is formed in the accommodation member 152. The accommodation hole 160 extends from the front end of the protuberant portion 156 to the center in the thickness direction of the base portion 154. The cross-sectional shape of the accommodation hole 160 may be circular. The opening at the front end of the accommodation hole 160 is opposed to the outer peripheral surface of the rotating spindle 88. A projection 162 is formed at the center of the bottom surface of the accommodation hole 160. An annular jut 164 is formed at the front end of the accommodation hole 160. The stop member 150 has a cylindrical head portion 166 of a relatively large diameter, and a cylindrical shaft portion 168 of a relatively small diameter, and is housed in the accommodation hole 160 of the accommodation member 152. An elastic biasing means 170 composed of a helical compression spring is also housed in the accommodation hole 160. The elastic biasing means 170 is disposed around the shaft portion 168 of the stop member 150, and is interposed between the annular jut 164 of the accommodation hole 160 and the head portion 166 of the stop member 150. Thus, the elastic biasing means 170 elastically biases the stop member 150 in a direction away from the rotating spindle 88 and, as shown in FIG. 5-A, elastically biases the stop member 150 to a nonoperating position where the head portion 166 of the stop member 150 contacts the projection 162 formed at the bottom surface of the accommodation hole 160. When the stop member 150 is located at the nonoperating position shown in FIG. 5-A, the stop member 150 does not protrude from the opening at the front end of the accommodation hole 160, and its substantial whole is housed in the accommodation hole 160.

An air supply passage 172 communicating with a rear end portion (right end portion in FIG. 5-A) of the accommodation hole 160 is also formed in the base portion 154 of the accommodation member 152. The air supply passage 172 is selectively brought into communication with the compressed air source 108 and the atmosphere via a selector valve 174. When the air supply passage 172 is in communication with the atmosphere, the stop member 150 is located at the nonoperating position shown in FIG. 5-A by the elastic biasing action of the elastic biasing means 170. When the air supply passage 172 is brought into communication with the compressed air source 108, on the other hand, compressed air is supplied to the rear end portion of the accommodation hole 160 through the air supply passage 172, and this compressed air acts on the rear end of the stop member 150, thereby forcing the stop member 150 leftward in FIG. 5-A against the elastic biasing action of the elastic biasing means 170. As shown in FIG. 5-B, when any one of the stop concavities 148 formed in the rotating spindle 88 is not in alignment with the free end of the stop member 150, the free end of the stop member 150 urged by the compressed air is pressed against the outer peripheral surface of the rotating spindle 88. When the rotating spindle 88 is rotated somewhat to bring one of the stop concavities 148 into alignment with the free end of the stop member 150, the stop member 150 urged by compressed air is advanced to an operating position shown in FIG. 5-C, whereby its free end is engaged with the interior of the stop concavity 148. As a result, the rotation of the rotating spindle 88 is inhibited. When the air supply passage 172 is brought into communication with the atmosphere to discharge compressed air from the accommodation hole 160, the stop member 150 is returned to the nonoperating position shown in FIG. 5-A. Thus, the free end of the stop member 150 recedes from the stop concavity 148, so that the rotation of the rotating spindle 88 is permitted.

Further with reference to FIG. 5 together with FIG. 4, when the rotating drive source 110 composed of the electric motor is deenergized in the above-described cutting means 44, the rotating spindle 88 is in a freely rotatable state. Thus, when the nut member 134 used to mount the rotary tool 90 on the rotating spindle 88 is to be mounted on or detached from the rotating spindle 88, or when the nut member 144 is to be mounted on or detached from the mounting implement 116, it is necessary to inhibit the rotation of the rotating spindle 88 and rotate the nut member 134 or 144 in a predetermined direction. In the machining apparatus constructed in accordance with the present invention, the rotation of the rotating spindle 88 can be inhibited simply by operating the selector valve 174 to bring the air supply passage 172 into communication with the compressed air source 108. When the air supply passage 172 is brought into communication with the compressed air source 108, the stop member 150 is forced leftward in FIG. 5-A against the elastic biasing action of the elastic biasing means 170. When one of the stop concavities 148 is in alignment with the free end of the stop member 150, the stop member 150 is moved to the operating position shown in FIG. 5-C, whereby the free end of the stop member 150 is engaged with the stop concavity 148. As a result, the rotation of the rotating spindle 88 is inhibited. When one of the stop concavities 148 is out of alignment with the free end of the stop member 150, the rotating spindle 88 is rotated somewhat until one of the stop concavities 148 aligns with the free end of the stop member 150. After some rotation of the rotating spindle 88, the free end of the stop member 150 is brought into engagement with the stop concavity 148. Thus, the rotation of the rotating spindle 88 is inhibited.

As noted above, the preferred embodiments of the machining apparatus constructed in accordance with the present invention have been described in detail with reference to the accompanying drawings. However, it should be understood that various modifications and changes can be made without departing from the scope and spirit of the present invention.

In the illustrated embodiments, for example, the stop member 150 is urged to the operating position by compressed air. Instead, the stop member 150 can be urged to the operating position by an electromagnetic solenoid or other actuating means. If desired, moreover, a suitable manual operating lever may be disposed, and the stop member 150 can be urged to the operating position by manually operating such a manual operating lever. In this case, it is desirable to annex to the manual operating lever a locking mechanism which can releasably lock the manual operating lever in a state where the stop member 150 has been urged to the operating position.

Furthermore, in the illustrated embodiments, the rotary tool 90 having the annular cutting blade 138 fixed to the hub 136 is used. However, various types of rotary tools can be used, such as a rotary tool of the type composed of the annular cutting blade alone (such a rotary tool can be mounted on the rotating spindle 88 by holding the rotary tool between the mounting implement 116 and a corresponding grasping member).

Besides, in the illustrated embodiments, the nut member 134 is screwed to the external thread formed in the front end portion of the rotating spindle 88. Instead, it is permissible to form an internally threaded hole in the front end surface of the rotating spindle 88, and screw a bolt member into this internally threaded hole, thereby applying a force, which urges the mounting implement 116 rearward, from the head of the bolt member to the front surface of the mounting implement 116.

What I claim is:

1. A machining apparatus comprising:

a rotating spindle mounted rotatably, a rotating drive source for rotationally driving said rotating spindle, a rotary tool detachably mounted on said rotating spindle, and at least one screwed member screwed to said rotating spindle for mounting said rotary tool on said rotating spindle, wherein a selective rotation inhibiting means is disposed for selectively inhibiting rotation of said rotating spindle, and said selective rotation inhibiting means includes at least one stop concavity formed in an outer peripheral surface of said rotating spindle, and a stop member to be selectively located at an operating position where said stop member engages said stop concavity, and a nonoperating position where said stop member recedes from said stop concavity, wherein said selective rotation inhibiting means further includes an accommodation member having, formed therein, an accommodation hole having an opening opposed to the outer peripheral surface of said rotating spindle, said stop member is slidably accommodated in said accommodation hole, and when said stop member is located at said operating position, a front end portion thereof partly protrudes from said opening of said accommodation hole, while when said stop member is located at said nonoperating position, a substantial whole thereof is accommodated in said accommodation hole, and wherein said selective rotation inhibiting means further includes elastic biasing means for elastically biasing said stop member to said nonoperating position, and forced slide means for selectively sliding said stop member to said operating position against an elastic biasing action of said elastic biasing means.

2. The machining apparatus according to claim 1, wherein said forced slide means causes compressed air to act on a rear end of said stop member.

* * * * *